US010302252B2

(12) United States Patent
Kuczek et al.

(10) Patent No.: US 10,302,252 B2
(45) Date of Patent: May 28, 2019

(54) CONTAINER HAVING AN INTERNAL STRUCTURE WITH MINIMUM SURFACES

(71) Applicant: UNITED TECHNOLOGIES CORPORATION, Farmington, CT (US)

(72) Inventors: Andrzej Ernest Kuczek, Bristol, CT (US); Matthew E. Lynch, Canton, CT (US); Paul F. Croteau, Columbia, CT (US); Tahany Ibrahim El-Wardany, Bloomfield, CT (US); Ellen Y. Sun, South Windsor, CT (US); Wenping Zhao, Glastonbury, CT (US); Daniel V. Viens, Mansfield Center, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 224 days.

(21) Appl. No.: 15/302,532

(22) PCT Filed: Apr. 14, 2014

(86) PCT No.: PCT/US2014/033949

§ 371 (c)(1),
(2) Date: Oct. 7, 2016

(87) PCT Pub. No.: WO2015/160324

PCT Pub. Date: Oct. 22, 2015

(65) Prior Publication Data

US 2017/0030519 A1 Feb. 2, 2017

(51) Int. Cl.

*F17C 1/08* (2006.01)
*F17C 1/14* (2006.01)
(Continued)

(52) U.S. Cl.

CPC ..... *F17C 1/08* (2013.01); *F17C 1/14* (2013.01); *F28F 3/086* (2013.01); *F28F 3/12* (2013.01);
(Continued)

(58) Field of Classification Search

CPC ..... F17C 1/08; F17C 1/14; F17C 2201/0147; F17C 2201/2201; F17C 2201/0157; F17C 2201/0161; F28F 3/086; F28F 3/14
See application file for complete search history.

(56) References Cited

U.S. PATENT DOCUMENTS 3,663,346 A 5/1972 Schoen
3,925,941 A 12/1975 Pearce
(Continued)

FOREIGN PATENT DOCUMENTS

CA 1062671 9/1979
WO 2013/142178 A1 9/2013

OTHER PUBLICATIONS

International Preliminary Report on Patentability for International application No. PCT/US20144/033949 dated Oct. 27, 2016.
(Continued)

*Primary Examiner* — Fenn C Mathew
*Assistant Examiner* — Jennifer Castriotta
(74) *Attorney, Agent, or Firm* — Carlson, Gaskey & Olds

(57) ABSTRACT

An illustrative example container includes a plurality of internal support members having a surface contour that at least approximates a minimum surface. The plurality of internal support members collectively provide structural support for carrying loads on the container. The plurality of internal support members collectively establish a plurality of cavities for at least temporarily containing fluid. An outer shell is connected with at least some of the internal support
(Continued)

members. The outer shell includes a plurality of curved surfaces. The outer shell encloses the cavities.

24 Claims, 5 Drawing Sheets

(51) Int. Cl.
*F28F 3/08* (2006.01)
*F28F 3/12* (2006.01)

(52) U.S. Cl.
CPC ..... *F17C 2201/0147* (2013.01); *F17C 2201/0157* (2013.01); *F17C 2201/054* (2013.01); *F17C 2201/056* (2013.01); *F17C 2203/013* (2013.01); *F17C 2203/0636* (2013.01); *F17C 2209/221* (2013.01); *F17C 2223/0123* (2013.01)

(56) References Cited

U.S. PATENT DOCUMENTS 7,156,257 B2 1/2007 de la Serna
7,866,377 B2 1/2011 Slaughter
9,234,626 B2 * 1/2016 Simmons ..... B21D 26/021
2004/0173618 A1 9/2004 Suzuki et al.
2010/0276434 A1 11/2010 Berger et al.
2011/0056960 A1 3/2011 Blanc et al.
2015/0014323 A1 * 1/2015 Loukus ..... F17C 1/00 220/564

OTHER PUBLICATIONS

Fiona Meldrum's Group, Mechanical Properties of Bio-Inspired Materials, School of Chemistry, University of Leeds, Woodhouse Lane, Leeds, LS2 9JT, 5 pages.
Shin, et al., Finite Element Analysis of Schwarz P Surface Pore Geometries for Tissue-Engineered Scaffolds, Hindawi Publishing Corporation, Mathematical Problems in Engineering, vol. 2012, Artile ID 694194, 13 pages, doi:10.1155/2012/694194.
International Search Report and Written Opinion of the International Searching Authority for International application No. PCT/US2014/033949 dated Sep. 3, 2014.

* cited by examiner

CONTAINER HAVING AN INTERNAL STRUCTURE WITH MINIMUM SURFACES

STATEMENT REGARDING FEDERALLY SPONSORED RESEARCH OR DEVELOPMENT

This invention was made with government support under Contract No. DE-AR0000254 awarded by the United States Department of Energy. The Government therefore has certain rights in this invention.

BACKGROUND

A variety of containers for various purposes are known. Many such containers must withstand pressure because the contents within the container are pressurized. One example application for such containers is to store gas for a variety of consumer, commercial, and industrial processes. Such gas storage containers typically must withstand relatively high pressures.

One attempt at configuring the containers to withstand high pressures includes using a spherical or cylindrical shape for the container. While those containers may be capable of withstanding relatively high pressures, they do not efficiently use space. By comparison to a rectangular prism-shaped container, a cylindrical container has a space use efficiency of about 78 percent and a spherical container has a space use efficiency of about 52 percent.

SUMMARY

An illustrative example container includes a plurality of internal support members having a surface contour that at least approximates a minimum surface. The plurality of internal support members collectively provide structural support for carrying loads on the container. The plurality of internal support members collectively establish a plurality of cavities for at least temporarily containing fluid. An outer shell is connected with at least some of the internal support members. The outer shell includes a plurality of curved surfaces. The outer shell encloses the cavities.

In an example container having one or more features of the container of the previous paragraph, the surface contour of the support members directs forces along a direction, the outer shell curved surfaces have a surface profile, and the surface profile is situated so that the forces along the direction are distributed approximately equally along the curved surfaces.

In an example container having one or more features of the container of either of the previous paragraphs, interiors of the plurality of internal support members collectively establish at least one first cavity for at least temporarily containing fluid, exteriors of the plurality of internal support members collectively establish at least one second cavity for at least temporarily containing fluid, the outer shell curved surfaces include a plurality of first curved surfaces closing the first cavity, the outer shell curved surfaces include a plurality of second curved surfaces closing the second cavity, the first curved surfaces have a first surface profile, and the second curved surfaces have a second, different surface profile.

In an example container having one or more features of the container of any of the previous paragraphs, a portion of one of the first curved surfaces is connected to one of the interior support members at an interface, a portion of one of the second curved surfaces is connected to the one of the interior support members at the interface, and the first surface profile of the one of the first curved surfaces and the second surface profile of the one of the second curved surfaces are situated to substantially counteract a moment on the one of the first curved surfaces and the one of the second curved surfaces at the interface.

In an example container having one or more features of the container of any of the previous paragraphs, at least the first curved surfaces are substantially semi-spherical, and the first curved surfaces have a convex shape on an exterior of the container.

In an example container having one or more features of the container of any of the previous paragraphs, the second curved surfaces are substantially semi-spherical, and the second curved surfaces have a convex shape on an exterior of the container.

In an example container having one or more features of the container of any of the previous paragraphs, the interior support members respectively include connection interfaces configured to be connected to another interior support member or a portion of the outer shell, and the surface contour of the respective interior support members directs a load on the container in a direction generally perpendicular to the connection interface.

In an example container having one or more features of the container of any of the previous paragraphs, the connection interfaces are generally circular.

In an example container having one or more features of the container of any of the previous paragraphs, the outer shell defines a shape of the container, and the shape corresponds to a substantially rectangular prism.

In an example container having one or more features of the container of any of the previous paragraphs, the surface contour comprises a P surface.

An example container having one or more features of the container of any of the previous paragraphs includes a fluid within the container and the fluid is pressurized.

In an example container having one or more features of the container of any of the previous paragraphs, the container is configured as a heat exchanger.

In an example container having one or more features of the container of any of the previous paragraphs, the internal support members comprise metal, and the outer shell comprises metal.

In an example container having one or more features of the container of any of the previous paragraphs, the internal support members respectively comprise an interior surface and an exterior surface, the interior surface at least approximates a minimum surface, and the exterior surface at least approximates a minimum surface.

In an example container having one or more features of the container of any of the previous paragraphs, the outer shell comprises a plurality of corner members, a plurality of edge members situated between the corner members, and a plurality of face members; corresponding ones of the corner members, the edge members and the face members are secured together; and corresponding ones of the internal support members are secured to corresponding ones of the corner members, edge members or face members.

An illustrative example method of making a container includes forming a plurality of internal support members including establishing a surface contour of the internal support members, wherein the surface contour at least approximates a minimum surface. The plurality of internal support members are connected to establish a plurality of cavities for at least temporarily containing fluid. An outer shell having a plurality of curved surfaces is formed. The outer shell is connected with at least some of the internal support members to enclose the cavities. The internal support members collectively provide structural support for carrying loads on the container.

In an example method having one or more features of the method of the previous paragraph, forming the plurality of internal support members comprises: shaping a first sheet of material to establish the surface contour of at least one portion of at least some of the internal support members, shaping a second sheet of material to establish the surface contour of at least another portion of the sum of the internal support members, and connecting the shaped first sheet of material to the shaped second sheet of material.

In an example method having one or more features of the method of either of the previous paragraphs, shaping additional sheets of material establishes the surface contours of additional ones of the plurality of internal support members; and respective ones of the shaped additional sheets are connected together.

In an example method having one or more features of the method of any of the previous paragraphs, forming the outer shell comprises shaping a plurality of sheets of material respectively to establish the plurality of curved surfaces on each of the sheets.

In an example method having one or more features of the method of any of the previous paragraphs, the shaped sheets respectively include a plurality of openings among the curved surfaces, forming the outer shell includes obtaining a plurality of curved cap members having a shape and size corresponding to a shape and size of the openings, and respective ones of the curved cap members are connected to at least one of an internal support member situated adjacent one of the openings or a corresponding one of the shaped sheets along a periphery of one of the openings.

Various features and advantages of example disclosed embodiments will become apparent to those skilled in the art from the following detailed description. The drawings that accompany the detailed description can be briefly described as follows.

DETAILED DESCRIPTION

Figure 1:
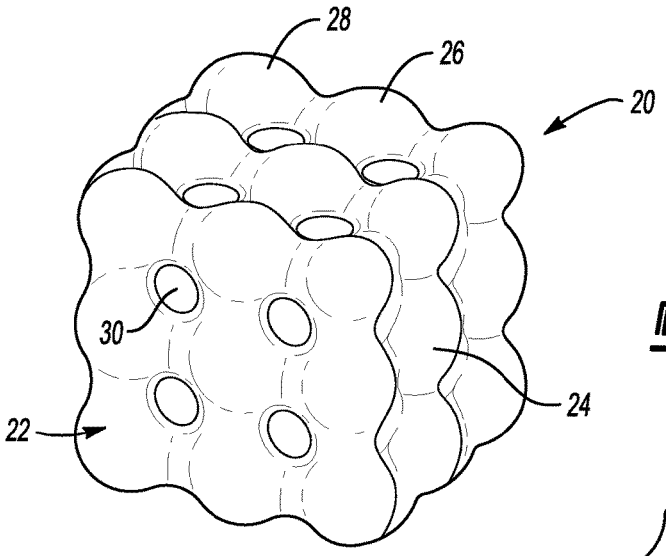
FIG. 1 schematically illustrates an example container designed according to an embodiment of this invention.

FIG. 1 schematically shows a container 20. From the perspective of FIG. 1, an outer shell 22 of the container 20 is visible. The outer shell 22 includes a plurality of curved surfaces 24, 26, 28 and 30. In this example, the curved surfaces are convex on the outside of the container and concave on the inside. The curved surfaces 24 are positioned on sides or faces of the example container 20. The curved surfaces 26 are positioned along edges of the example container 20. The curved surfaces 28 are situated at corners of the example container 20. Curved surfaces 30 are along sides or faces of the example container 20.

A container, such as the container 20, is configured to contain a pressurized fluid, such as a gas, liquid or gel. The container 20 includes the outer shell 22 and a plurality of internal support members that are configured to withstand the stress due to an internal pressure load without failing and with uniform displacement of the outer walls, similar to that of a cylinder or sphere under pressure. As can be appreciated from FIG. 1, the container 20 has a shape or envelope that approximates a rectangular prism. This is significantly different than previous container arrangements that were generally spherical or cylindrical in shape. The manner in which the container 20 is configured allows for having a generally rectangular prism shape while withstanding relatively high pressures.

In some embodiments, the container 20 contains a fluid for a prolonged period of time. In other embodiments, the container 20 is used for dynamically or only temporarily containing a fluid as it essentially passes through the container 20. It follows that the word "container" should not be construed in a particular manner that requires a static or long-term containment of a fluid.

Figure 2:
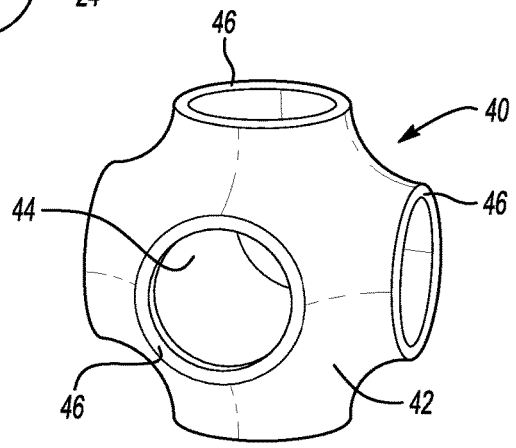
FIG. 2 schematically illustrates an example embodiment of an internal support member useful with an embodiment of this invention.

FIG. 2 schematically shows an example embodiment of an internal support member 40. A surface contour of the internal support member 40 includes a plurality of surfaces that at least approximate a minimum surface. In this example, the surface contour of an outside or external surface 42 of the internal support member 40 at least approximates a minimum surface. An internal or inside surface 44 has a surface contour that also at least approximates a minimum surface. The internal support member 40 also includes a plurality of connecting interfaces 46 that are useful for connecting a plurality of internal support members 40 together to establish a network of cavities or passages for at least temporarily containing fluid.

The term "minimum surface" as used in this description refers to a minimum surface as known in mathematics. In some examples, the surface contour of the internal support members at least approximates a minimum surface. In other examples, the surface contour on the internal support members is exactly a minimum surface for at least a portion of the surface contour. In an example embodiment having internal support members 40 like that shown in FIG. 2, the surface contour comprises a surface that is the same as or similar to a Schwarz P-surface. The features of minimal surfaces and Schwarz P-surfaces are known. Having at least approximately a minimal surface provides structural stability with the use of a minimum of material to the container 20.

Figure 3:
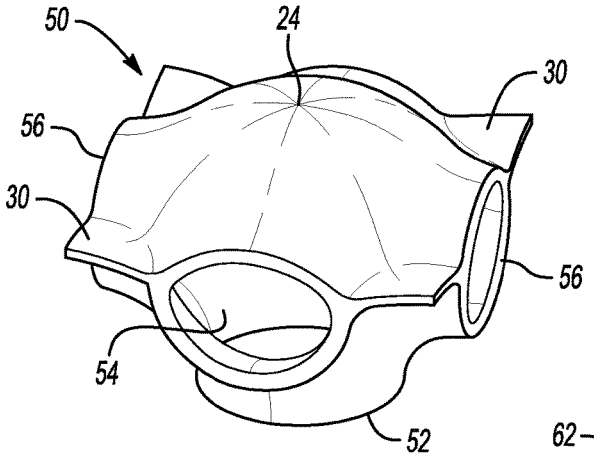
FIG. 3 schematically illustrates an example outer shell face member that is useful with an embodiment of this invention.

FIG. 3 schematically illustrates an example embodiment of a face member 50. In this example, the face member 50 includes a curved surface 24 that is part of the outer shell 22 as shown in FIG. 1. The face member 50 also includes sections of the curved surfaces 30 in the illustration. The curved surfaces 30 are not necessarily segmented as shown in FIG. 3.

The face member 50 includes a connecting interface 52 that is configured to correspond to a connecting interface 46 on an internal support member 40, such as that shown in FIG. 2. The face member 50 includes an internal surface 54 having a surface contour that at least approximates a minimum surface along at least a portion of that surface contour. A plurality of connecting interfaces 56 allow for connecting multiple face members 50 together or securing the example face member 50 to another portion of the outer shell of a container, such as the example container 20 shown in FIG. 1.

Figure 4:
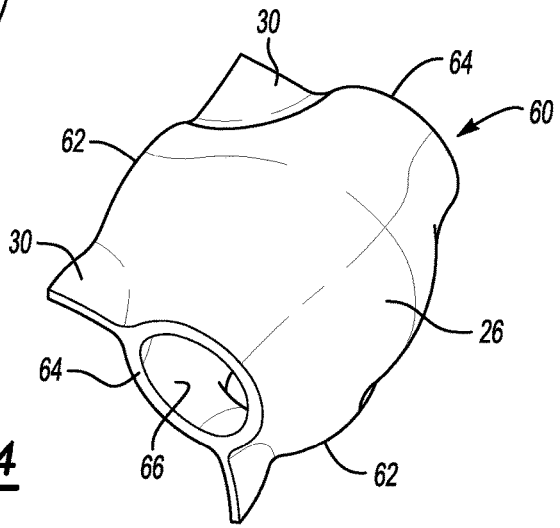
FIG. 4 schematically illustrates an example outer shell edge member that is useful with an embodiment of this invention.

FIG. 4 schematically shows an example embodiment of an edge member 60. In this example, the edge member 60 includes a plurality of connecting interfaces 62 and 64 that are configured for connection with connecting interfaces 56 on a face member, such as the face member 50 shown in FIG. 3, to other edge members, or to another portion of the outer shell 22.

In this example, the edge member 60 has an interior surface 66 with a surface contour that at least approximates a minimum surface along at least a portion of that surface contour. The edge member 60 includes the curved surface 26 on an exterior of the edge member 60.

Figure 5:
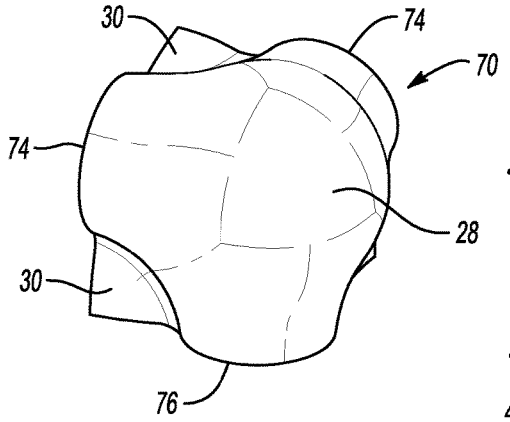
FIG. 5 schematically illustrates an example outer shell corner member that is useful with an embodiment of this invention.

FIG. 5 schematically illustrates an example corner member 70 that includes a curved exterior surface 28 as shown in the illustration of FIG. 1. The corner member 70 includes connection interfaces 74 and 76 that are configured to be connected to connection interfaces 64 of edge members 60, such as the examples shown in FIG. 4, or to another corner member. Although not visible in FIG. 5, portions of an interior surface of the corner member 70 include a surface contour that at least approximates a minimum surface.

Some example embodiments comprise a plurality of the internal support members 40, a plurality of the face members 50, a plurality of the edge members 60 and a plurality of the corner members 70. The connection interfaces are secured together using an appropriate technique based upon the material of the different members. For example, when the plurality of members comprise metal, a welding technique may be used for securing the interfaces together in a manner that provides a stable container that is able to withstand pressures of a pressurized fluid within the container in a leak-proof manner.

Figure 6:
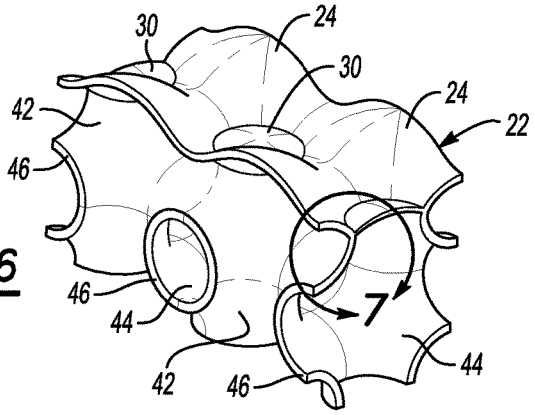
FIG. 6 schematically illustrates selected portions of an example container designed according to an embodiment of this invention.
Figure 7:
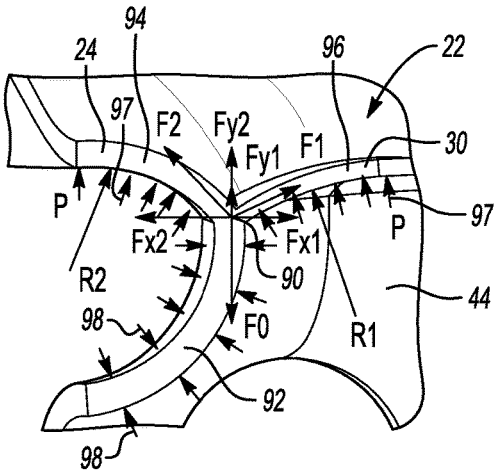
FIG. 7 schematically shows selected features of the portion of the illustration of FIG. 6 indicated at 7.

FIG. 6 schematically illustrates selected portions of an example container including internal support members 40 and an outer shell 22. This example embodiment does not necessarily include base members 50, edge members 60 or corner members 70, such as those shown in FIGS. 3-5. FIG. 7 schematically shows, in more detail, the portion of FIG. 6 within the box labeled 7. FIG. 7 provides insight into how the various surface contours of the container cooperate together to provide a stable container structure that is able to withstand internal pressures without significant or undesirable deformation of the outer shell, even though the container has a generally rectangular prism configuration.

Figure 8:
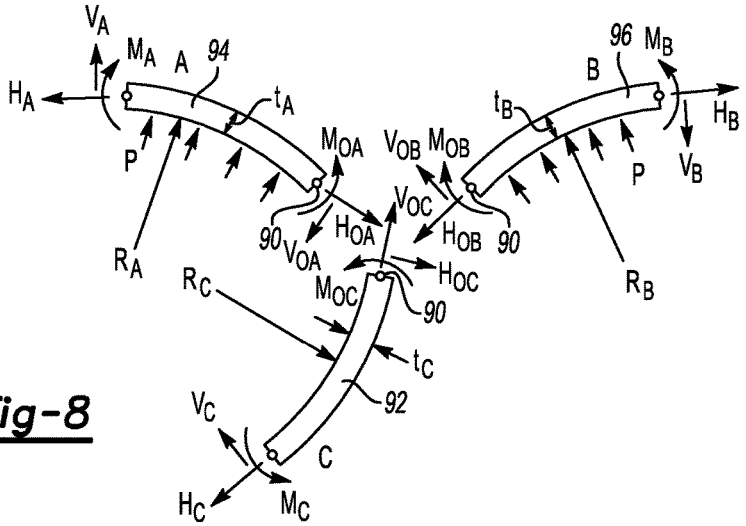
FIG. 8 schematically shows a free body diagram with loads and reaction forces and moments associated with the illustrated surface arrangement.

FIGS. 7 and 8 illustrate a feature of the disclosed example embodiment that includes minimizing stress in the outer shell 22 that has the curved surfaces. In this example, stress in the outer shell 22 is minimized by minimizing bending stress in each of the outer shell components by providing a balanced load share at the junction of the two outer curved surfaces 94 and 96 and one internal curved support 92.

FIG. 7 represents a free body diagram illustrating a balance of component forces in each of two directions shown at F1 and F2. The sum of the forces in one of the directions (x) represented at Fx1 and Fx2 is zero. Similarly, the sum of forces in the second direction (y) is represented at Fy1 and Fy2. The sum of those forces is zero. Additionally, FIG. 8 further illustrates in general the applied internal pressure load and reaction forces and moments of each member. As a rule of free body diagrams, the addition of reaction loads and moments at the junction "O" of the three members must equal zero to be in equilibrium.

For discussion purposes, the forces are considered to originate at an intersecting point or location 90 between an internal support member surface 92 and outer shell surfaces 94 and 96. The partially spherical surfaces 94 and 96 of the outer shell experience moments at their edges due to the pressure load. The internal support member surface shown at 92 experiences pressure on both sides represented by the arrows 98. The pressure load causing the moment on the outer shell surfaces is schematically shown by the arrows 97. While the moment load in the curved beams or surfaces 94 and 96 are not completely eliminated, the effect on the structure and its stress is effectively minimized by balancing the loads on the three members or surfaces 92, 94 and 96. This arrangement reduces the moment in the wall so that the wall effectively behaves like that of a cylinder or sphere with a hoop stress. A cylinder wall under pressure has a maximum stress at the inner diameter, with a somewhat lower stress on the outer diameter of the wall. When one considers an isolated segment of the wall, this stress difference creates a moment. In the illustrated arrangement the inner wall 92, for example, with a zero net pressure, will experience a moment from its reaction force and the fact that it curved. Balancing such moment loads among the three surfaces 92, 94, 96 provides the ability for the external structure to behave like the curved external wall of a cylinder or sphere when subjected to internal pressure.

The stress in the outer shell adjacent to the intersection 90 is minimized by balancing the curvature of the surfaces 92, 94, and 96 along with the thickness of those walls, respectively, such that the magnitudes of the moments M0, M1, and M2 shown in FIG. 8 are minimized and their sum equals zero.

Figure 9A:
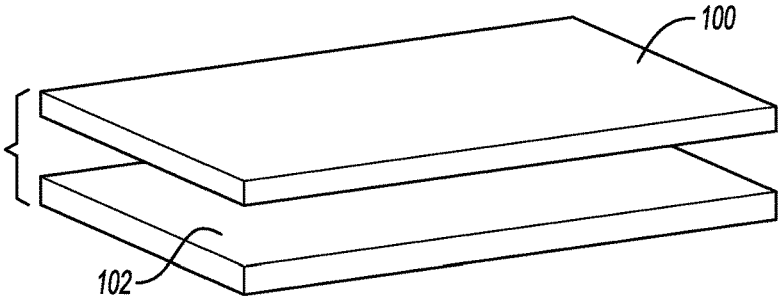
FIGS. 9A-9G schematically illustrate various stages of an example method of making a container designed according to an embodiment of this invention.

FIGS. 9A-9G schematically illustrate a manufacturing process for making an example embodiment of a container like the one shown in FIG. 1. This example process includes using generally flat or planar sheets of material 100 and 102 as shown in FIG. 9A. Depending on the particular use of the container, the material may vary. For purposes of discussion and illustration, a metal material is considered as an example.

Figure 9B:
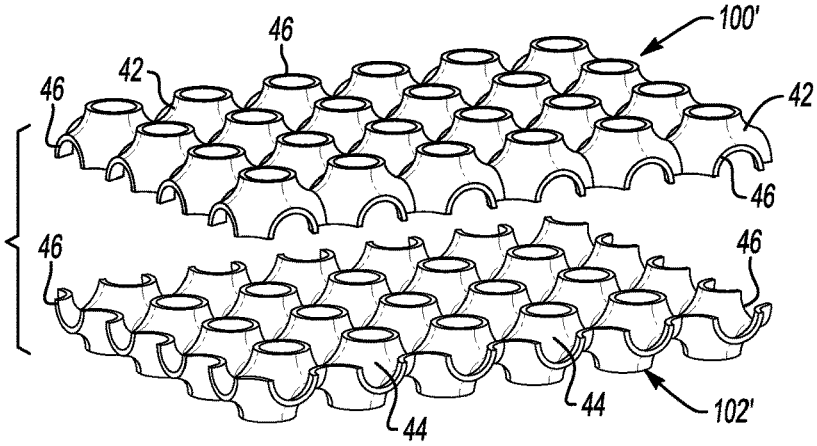

Each of the sheets 100 and 102 are shaped using a forming process, such as hot press forming, to establish a desired configuration, such as that shown in FIG. 9B. In this example, the sheet 100 has been shaped into a first portion of internal support members. The shaped sheet is shown at 100'. The sheet 102 has been shaped into another portion of a plurality of internal support members shown at 102'. In this example, the first portion 100' includes a plurality of connection interfaces 46, a plurality of exterior surfaces 42 and interior surfaces 44. The second portion 102' also includes a plurality of connection interfaces 46, exterior surfaces 42 and interior surfaces 44.

Figure 9C:
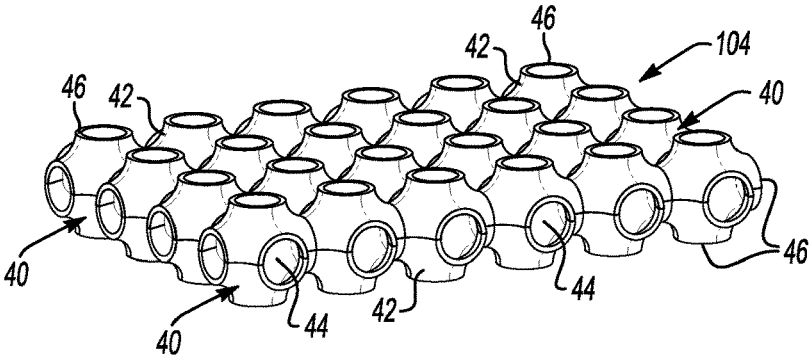

FIG. 9C shows the first portion 100' and the second portion 102' secured together to establish a plurality of internal support members 40 in a matrix-style arrangement shown at 104. When metal is used as the base material of the internal support members, the first portion 100' and the second portion 102' may be secured together using a welding technique, for example. Given this description, those skilled in the art will be able to select an appropriate technique for securing the portions together, depending on the material they have selected for the internal support members and the configuration of those members.

Figure 9D:
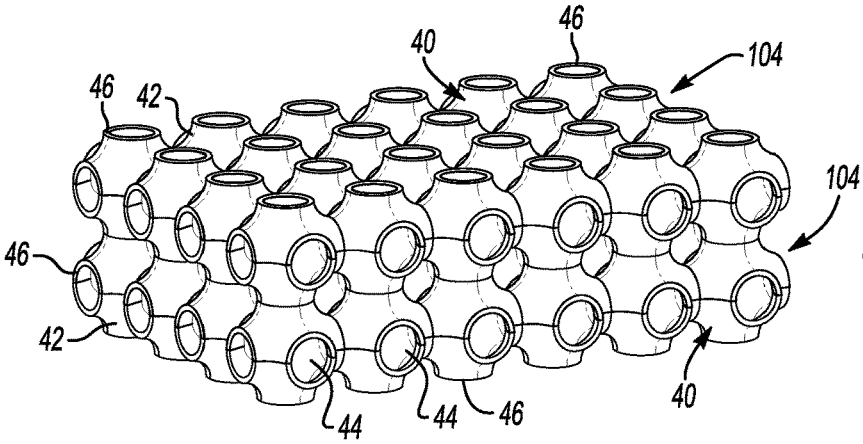

FIG. 9D illustrates a second set of internal support members 40 established into an arrangement 104 with all of the internal support members 40 secured together. As can be appreciated from FIG. 9D, it is possible to make a plurality of sets of internal support members 40 and to stack them or otherwise secure them together in a variety of configurations to realize different sizes and shapes of a container. The example of FIG. 9D includes a three dimensional matrix-type arrangement of the internal support members 40.

Figure 9E:
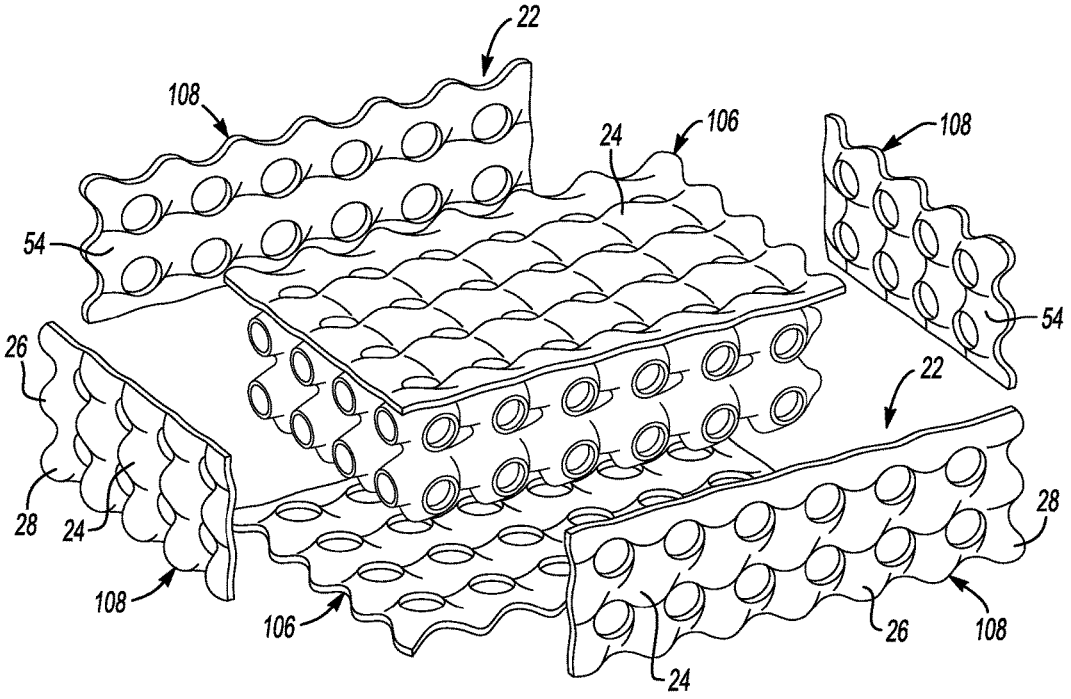

FIG. 9E schematically illustrates a plurality of skin portions 106 and 108 that are secured to the exterior of the plurality of internal support members 40 to establish the outer shell 22. In this example, the skin portions comprise shaped metal sheets or plates that are formed by shaping a generally flat piece of material. A hot press forming or stamping operation may be used to establish the curved surfaces and to punch out openings 112 in the example embodiment.

Figure 9F:
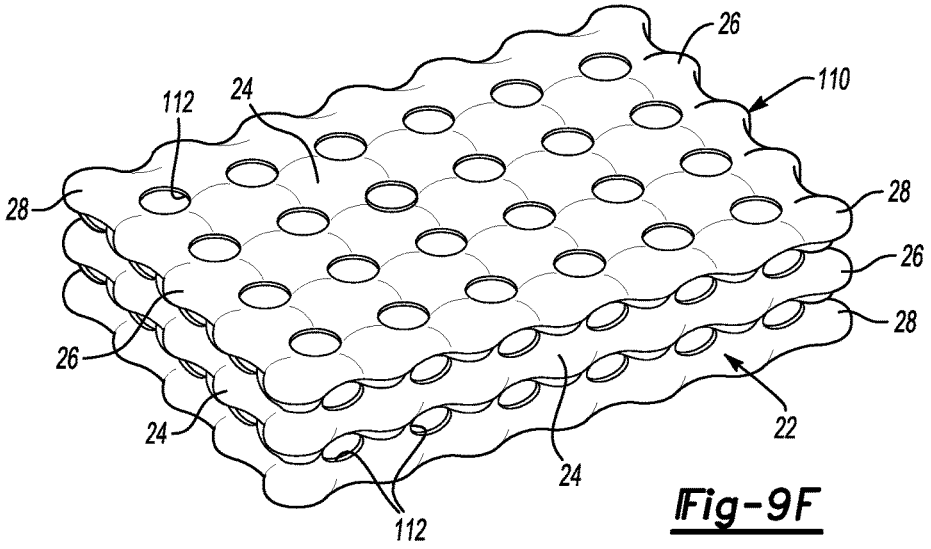

FIG. 9F illustrates the outer skin or plate pieces 108 secured to the internal support members 40 such that an intermediate version of the container 110 is established at this point. As can be appreciated from the illustration, a cavity is established within the container at this point between the interior of the outer shell 22 and the exterior surfaces 42 (not visible in FIG. 9F) of the internal support members 40. A plurality of cavities (e.g., two in this particular illustrated example) is established at this point within which a fluid could be contained where that fluid is in contact with the exterior surfaces 42 on the internal support members 40 and the interior of the portion of the outer shell 22 that is established in FIG. 9F.

Figure 9G:
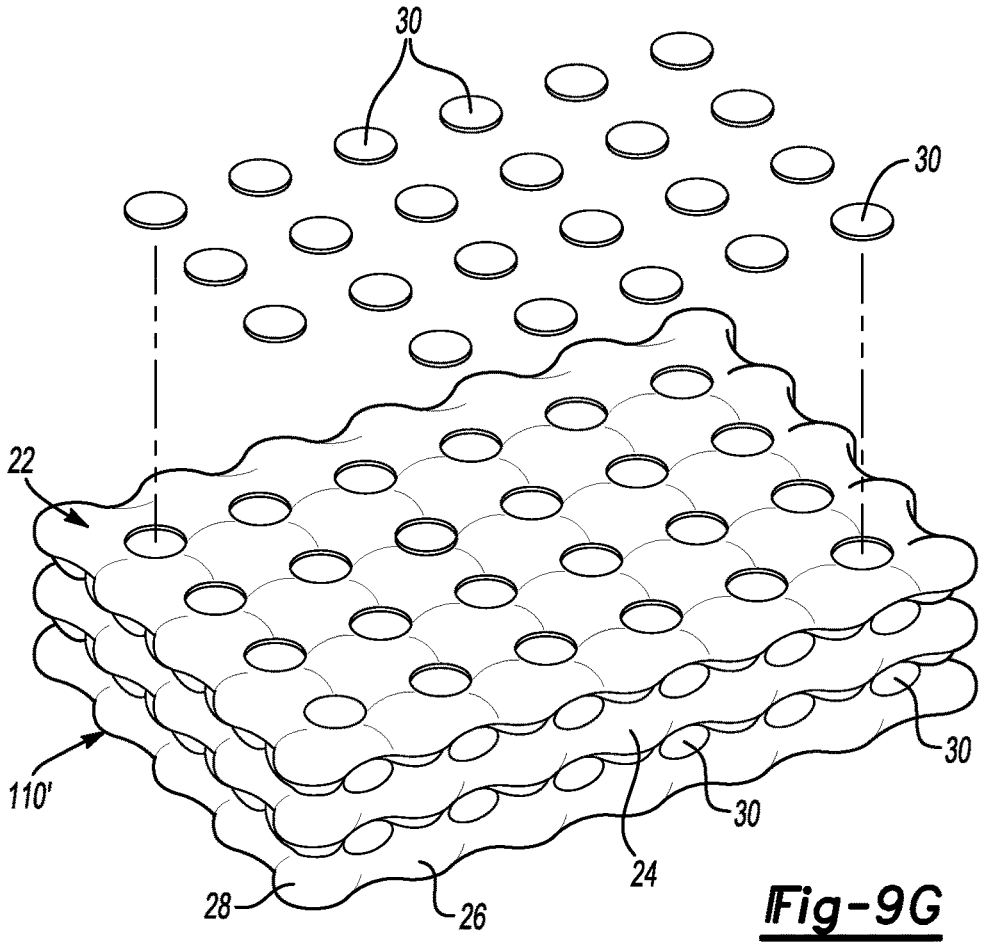
Figure 10:
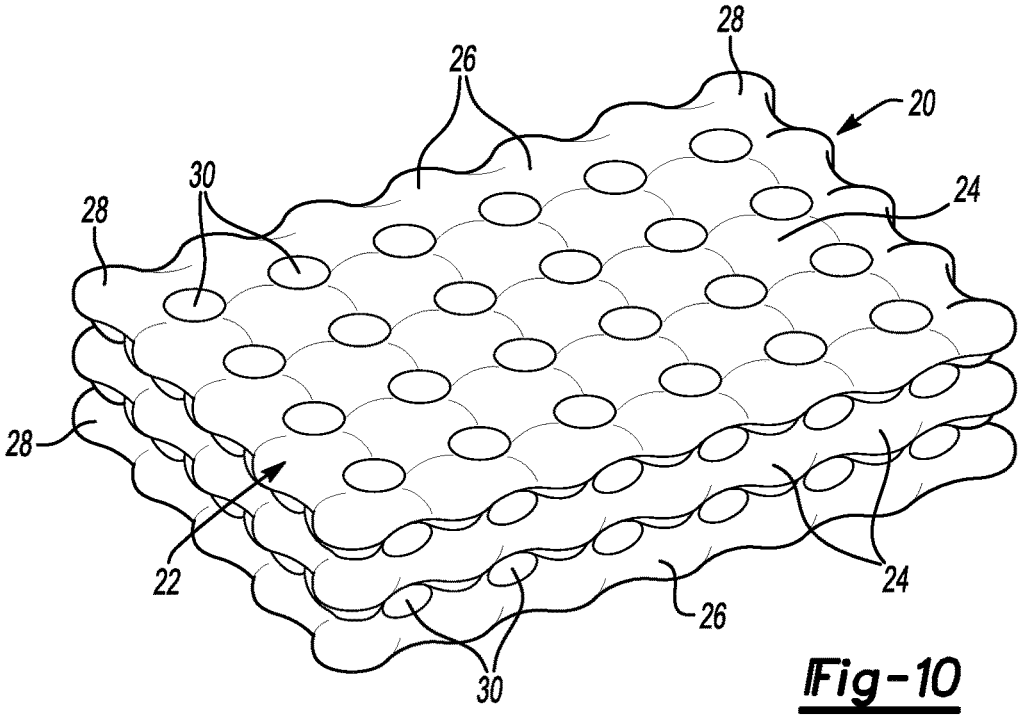
FIG. 10 schematically illustrates an example container embodiment resulting from the process schematically shown in FIGS. 9A-9G.

At the stage of manufacture shown in FIG. 9F, a plurality of openings 112 are situated on the outer shell 22. These openings 112 in this example correspond to the connection interfaces 46 on the internal support members (see, for example, FIGS. 2 and 9D). As shown in FIG. 9G, a plurality of plugs or disks that include the exterior curved surfaces 30 are secured in place to close off the openings 112. At the stage shown in FIG. 9G, not all of the openings 112 have been closed off by the plugs or disks 30 so that this intermediate version of the container is labeled 110'. Once all of the openings 112 have been sealed off using the disks or plugs 30, the container is complete as shown in FIG. 10.

While FIGS. 9A-9G illustrate an example method of making a container designed according to an embodiment of this invention, the container may be fabricated in a variety of ways. For example, the individual members or buildings elements shown in FIGS. 2-5 may be individually cast or formed, made by additive manufacturing or by joining pre-fabricated sub-components. Individual members may be secured to each other using interlocking features or a securing technique, such as welding or adhesively securing them together. Another approach includes using some of the techniques shown in FIGS. 9A-9G and individual elements in combination. For example, the internal support members 40 may be formed as shown in FIGS. 9A-9D and the outer skin may be established using face members 50 as shown in FIG. 3, edge members 60 as shown in FIG. 4 and corner members 70 as shown in FIG. 5. Those skilled in the art who have the benefit of this description will realize what manufacturing technique will meet the needs of their particular situation. The various manufacturing techniques disclosed in this document may be combined together in different ways, depending on the particular container and the availability of materials or manufacturing equipment, for example.

The welding techniques may be solid-state welding or fusion welding, depending on the materials selected for forming the different portions of the container. Solid state welding may include hot or cold pressure welding, friction stir pot welding, high frequency induction seam welding, advanced flash butt welding, projection spot welding or magnetically impelled arc butt welding processes.

Some examples may include a polymer or polymer matrix composite as the base material for the structure of the container. Such materials may include the advantage of lighter weight and an increased resistance to corrosion. One example includes sheet molding compound and using compression molding to fabricate the individual layers or pieces, which are then secured together using adhesive bonding. Fusion bonding may be used in embodiments that include thermoplastic matrix materials, such as PEEK and PEI. With fusion bonding, the polymer chains tend to inter-diffuse across the interface between pieces under heat and after cooling consolidation, the polymer chains are intertwined across the interface resulting in the bond line disappearing and an improved ability to transfer loads through the joint.

In embodiments that are intended to be used as a heat exchanger, a sheet metal forming technique as described above may provide economic advantages for forming titanium heat exchangers or using other alloy materials. With the illustrated example embodiments, composite materials having particular thermal properties may be selected to achieve desired heat exchange effects.

While not specifically illustrated, the container will include one or more openings for introducing a fluid into or removing a fluid from the container. A variety of closure mechanisms or valves may be incorporated to meet the needs of a particular situation. In a container such as that shown in the illustrations, different closure members may be used to control whether fluid enters or exits the two separate cavities within the container 20. One cavity includes a plurality of passages through the interiors of the connected internal support members 40. A second cavity includes passages along the outsides of the interconnected internal support members 40.

The different cavities and different fluid passages within a container such as the disclosed example embodiments makes the container useful for storing a single fluid or storing multiple fluids. Additionally, the container may be utilized as a heat exchanger between two fluids, with one of them being within the first cavity (e.g., within the internal support members 40) and the other fluid being in the other cavity within the container (e.g., on the outside of the internal support members 40).

In some embodiments, separate or isolated cavities exist within the container 20. In other embodiments, the internal support members 40 or the connections among them are configured to allow fluid to move from one cavity into the other, such as by including at least one hole in the wall of at least one of the internal support members. A plurality of cavities may be established within the container with those cavities being in fluid communication or isolated from each other depending on the needs of a particular situation.

Utilizing surfaces on the internal support members that at least approximate a minimal surface provides a uniform stress distribution along the structure of the container. In the illustrated examples, the connecting interfaces are generally circular, which provides even loading and the directions of the forces resulting from pressures inside the container tend to be in directions that are normal to the walls of the internal support members 40. With such an arrangement, little or no bending or shear tends to occur as the only load on the structure is a tension load.

The surfaces on the internal support members that at least approximate a minimum surface and the curved outer shell surfaces provide a container structure that is able to withstand internal pressures within the container with uniform displacement of the outer walls, because of the load balance provided by the surfaces and the arrangement of them, such as that schematically shown in FIGS. 7 and 8. The combination of surfaces allows for configuring the container to have an overall envelope that approximates a generally rectangular prism, for example. This allows for more efficient use of space overall while still providing a reliable containment of a fluid under a variety of pressurized conditions.

While various features and aspects of disclosed example embodiments are described above in connection with those particular embodiments, those features and aspects are not necessarily exclusive to the corresponding embodiment. The disclosed features and aspects may be combined in ways other than those specifically mentioned above. In other words, any feature of one embodiment may be included with or substituted for a feature of another embodiment.

The preceding description is illustrative rather than limiting in nature. Variations and modifications to the disclosed examples may become apparent to those skilled in the art that do not necessarily depart from the essence of the contribution to the art provided by the disclosed examples. The scope of legal protection provided to the invention can only be determined by studying the following claims.

We claim:

1. A container, comprising:

a plurality of internal support members having a surface contour that at least approximates a minimum surface, the plurality of internal support members collectively providing structural support for carrying loads on the container, the plurality of internal support members collectively establishing a plurality of cavities for at least temporarily containing fluid; and an outer shell connected with at least some of the internal support members, the outer shell including a plurality of curved surfaces, the outer shell enclosing the cavities, wherein interiors of the plurality of internal support members collectively establish at least one first cavity for at least temporarily containing fluid;

exteriors of the plurality of internal support members collectively establish at least one second cavity for at least temporarily containing fluid;

the outer shell curved surfaces include a plurality of first curved surfaces closing the first cavity;

the outer shell curved surfaces include a plurality of second curved surfaces closing the second cavity;

the first curved surfaces have a first surface profile; and the second curved surfaces have a second, different surface profile.

2. The container of claim 1, wherein the surface contour of the support members directs forces along a direction;

the outer shell curved surfaces have a surface profile; and the curved surfaces surface profile is situated so that the forces along the direction are distributed approximately equally along the curved surfaces.

3. The container of claim 1, wherein a portion of one of the first curved surfaces is connected to one of the interior support members at an interface;

a portion of one of the second curved surfaces is connected to the one of the interior support members at the interface; and the first surface profile of the one of the first curved surfaces and the second surface profile of the one of the second curved surfaces are situated to substantially counteract a moment on the one of the first curved surfaces and the one of the second curved surfaces at the interface.

4. The container of claim 1, wherein at least the first curved surfaces are substantially semi-spherical; and the first curved surfaces have a convex shape on an exterior of the container.

5. The container of claim 4, wherein the second curved surfaces are substantially semi-spherical; and the second curved surfaces have a convex shape on an exterior of the container.

6. The container of claim 1, wherein the interior support members respectively include connection interfaces configured to be connected to another interior support member or a portion of the outer shell; and the surface contour of the respective interior support members directs a load on the container in a direction generally perpendicular to the connection interface.

7. The container of claim 6, wherein the connection interfaces are generally circular.

8. The container of claim 1, wherein the outer shell defines a shape of the container; and the shape corresponds to a substantially rectangular prism.

9. The container of claim 1, wherein the surface contour comprises a P-surface.

10. The container of claim 1, comprising a fluid within the container and wherein the fluid is pressurized.

11. The container of claim 1, wherein the container is configured as a heat exchanger.

12. The container of claim 1, wherein the internal support members comprise metal; and the outer shell comprises metal.

13. The container of claim 1, wherein the internal support members respectively comprise an interior surface and an exterior surface;

the interior surface at least approximates a minimum surface; and the exterior surface at least approximates a minimum surface.

14. The container of claim 13, wherein the outer shell comprises:

a plurality of corner members, a plurality of edge members situated between the corner members, and a plurality of face members;

corresponding ones of the corner members, the edge members and the face members are secured together; and corresponding ones of the internal support members are secured to corresponding ones of the corner members, edge members or face members.

15. The container of claim 1, wherein the outer shell includes a plurality of members, wherein each of the plurality of members is connected with at least some of the internal support members, and wherein each of the plurality of members is connected with at least one other member of the plurality of members.

16. The container of claim 1, wherein the at least one first cavity is isolated from the at least one second cavity so as to not be configured to communicate fluid to the at least one second cavity.

17. A method of making a container, comprising the steps of:

forming a plurality of internal support members including establishing a surface contour of the internal support members, wherein the surface contour at least approximates a minimum surface;

connecting the plurality of internal support members to establish a plurality of cavities for at least temporarily containing fluid; and forming an outer shell having a plurality of curved surfaces including shaping a plurality of sheets of material respectively to establish the plurality of curved surfaces on the respective sheets;

connecting the outer shell with at least some of the internal support members to enclose the cavities, wherein the internal support members collectively provide structural support for carrying loads on the container.

18. The method of claim 17, wherein forming the plurality of internal support members, comprises:

shaping a first sheet of material to establish the surface contour of at least one portion of at least some of the internal support members;

shaping a second sheet of material to establish the surface contour of at least another portion of the some of the internal support members; and connecting the shaped first sheet of material to the shaped second sheet of material.

19. The method of claim 18, comprising:

shaping additional sheets of material to establish the surface contours of additional ones of the plurality of internal support members; and connecting respective ones of the shaped additional sheets together.

20. The method of claim 18, wherein forming the plurality of internal support members includes using hot press forming.

21. The method of claim 17, wherein the shaped sheets respectively include a plurality of openings among the curved surfaces; and forming the outer shell includes obtaining a plurality of curved cap members having a shape and size corresponding to a shape and size of the openings; and connecting respective ones of the curved cap members to at least one of an internal support member situated adjacent one of the openings or a corresponding one of the shaped sheets along a periphery of one of the openings.

22. The method of claim 21, wherein connecting respective ones of the curved cap members seals the plurality of cavities.

23. The method of claim 17, wherein connecting the plurality of internal support members includes solid-state welding.

24. The method of claim 17, wherein the container is configured as a heat exchanger and wherein the plurality of sheets comprises titanium or an alloy material.

* * * * *